US006910287B2

(12) United States Patent
Truelsen

(10) Patent No.: US 6,910,287 B2
(45) Date of Patent: Jun. 28, 2005

(54) SHOE MIDSOLE

(75) Inventor: Ejnar Truelsen, Tønder (DK)

(73) Assignee: Ecco Sko A/S, Bredebro (DK)

( * ) Notice: Subject to any disclaimer, the term of this patent is extended or adjusted under 35 U.S.C. 154(b) by 0 days.

(21) Appl. No.: 10/332,594

(22) PCT Filed: Aug. 8, 2001

(86) PCT No.: PCT/DK01/00527

§ 371 (c)(1),
(2), (4) Date: Feb. 10, 2003

(87) PCT Pub. No.: WO02/11573

PCT Pub. Date: Feb. 14, 2002

(65) Prior Publication Data

US 2003/0172553 A1 Sep. 18, 2003

(30) Foreign Application Priority Data

Jun. 9, 2000 (DK) ..... 2000 01190

(51) Int. Cl.[7] ..... A43B 7/32; A43B 7/14

(52) U.S. Cl. ..... 36/30 R; 36/88; 36/102; 36/108; 36/76 C

(58) Field of Search ..... 36/30 R, 88, 92, 36/102, 103, 107, 108, 44, 76 R, 76 C

(56) References Cited

U.S. PATENT DOCUMENTS

| | | | | | |
|---|---|---|---|---|---|
| 1,484,785 | A | * | 3/1924 | Hiss | 36/76 R |
| RE17,243 | E | * | 3/1929 | Hiss | 36/76 R |
| RE33,648 | E | * | 7/1991 | Brown | 36/44 |
| 5,255,451 | A | * | 10/1993 | Tong et al. | 36/30 A |
| 5,528,842 | A | * | 6/1996 | Ricci et al. | 36/27 |
| 6,098,313 | A | * | 8/2000 | Skaja | 36/28 |
| 6,125,557 | A | * | 10/2000 | Brown | 36/144 |
| 6,237,256 | B1 | * | 5/2001 | Maki et al. | 36/140 |
| 6,502,330 | B1 | * | 1/2003 | David et al. | 36/88 |

FOREIGN PATENT DOCUMENTS

| | | | | |
|---|---|---|---|---|
| EP | 0958752 | | 11/1999 | |
| FR | 2775875 | | 9/1999 | |
| WO | WO 93/05675 | * | 4/1993 | A43B/13/18 |
| WO | WO9818358 | | 5/1998 | |

* cited by examiner

*Primary Examiner*—Anthony Stashick
(74) *Attorney, Agent, or Firm*—Donald S. Dowden; Cooper & Dunham LLP

(57) ABSTRACT

A shoe midsole (1) for shoes with exceptional walking comfort, eg hiking shoes. The shoe midsole is provided with a shock absorber (6) in its heel zone (4) and a bead (8) behind and adjacent the heel zone, said bead completely or partially following a U-shape and forming a side support for the heel of the wearer. The sole is flexible about at least two slightly curved bending lines (12,14), which are inclined relative to the longitudinal axis (10) of the sole, said lines being defined by channels or grooves (12,14) in the sole material. The bending lines do not intersect each other and their cavities face away from each other. The sole (1) has a particularly elastic portion (16) of a hand-like shape with at least two finger-shaped zones (**18*a*,18*b*,18*c*) pointing towards the toe end (30**) of the midsole. As a result the shoe midsole offers a considerable degree of flexibility during the wearer's walking motion. More readily than known it conforms to the organic tissue of the wearer's foot in motion such that the shoe, of which the sole is to be part, is particularly comfortable to use for walking.

11 Claims, 3 Drawing Sheets

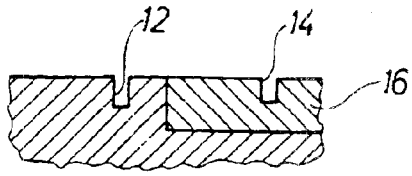
Fig. 3
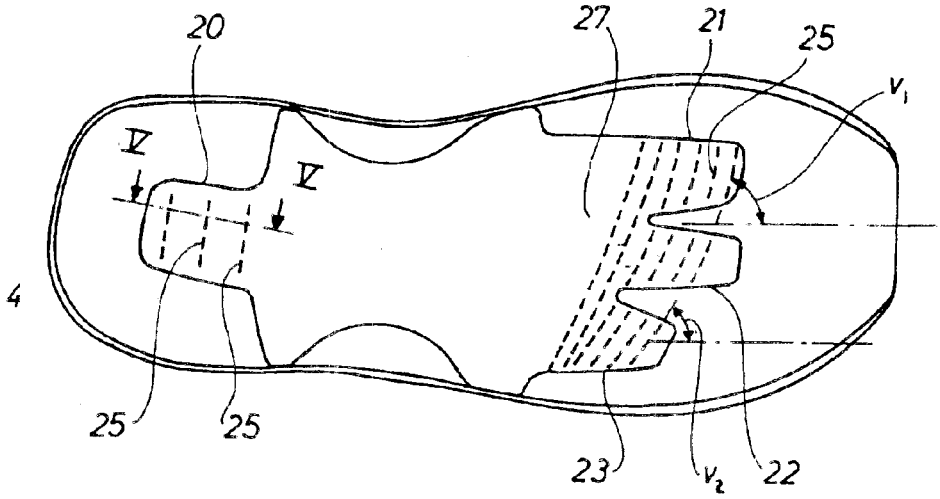
Fig. 4
Fig. 5
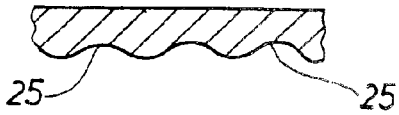
Fig. 6
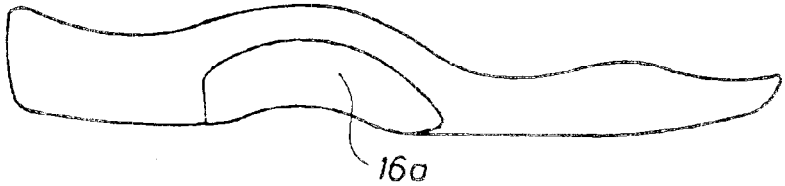

SHOE MIDSOLE

TECHNICAL FIELD

This application is a 371 of PCT/DK01/00527 filed 8 Aug., 2001. The invention relates to a shoe midsole for shoes affording exceptional walking comfort, eg hiking shoes, said shoe midsole provided with a shock absorber in its heel zone and at least one bead behind and adjacent the heel zone, said bead completely or partially following a U-shape and acting as side support to the heel of the shoe wearer.

BACKGROUND ART

It is known to produce shoe soles with heel zones provided with a shock absorber. Such shock absorbers may be provided in many different ways, eg by means of springs or air cushions. It is also known to provide a substantially U-shaped side support bead in such a shoe sole, said support bead being arranged behind and abutting the heel of the shoe wearer's to provide support. This sole is, however, not quite satisfactory, as it does not provide adequate flexibility during a shoe wearer's walking motion and does not conform adequately to the contour of the wearer's foot during walking. Thus, the sole does not enable the manufacture of a shoe, which is comfortable to use for walking and in particular for hiking.

BRIEF DESCRIPTIONS OF THE INVENTION

The object of the invention is to provide a shoe midsole of the above type providing a high degree of flexibility during motion as well as more readily than known soles conforming to the organic tissue of the wearer's foot in a motion cycle such that the shoe of which the shoe midsole is to form part is particularly comfortable to use for walking.

The shoe midsole according to the invention is characterised in that it is flexible about at least two slightly curved bending lines, which are inclined relative to the longitudinal axis of the sole, said lines being defined by channels or grooves in the sole material and not intersecting each other, the cavities of the bending lines facing opposite of each other, and in that a particularly elastic portion of a hand-like shape forming part of the shoe midsole with at least two finger-shaped zones pointing at the toe end of the sole. As a result a particularly comfortable finished shoe may be obtained, as the complete sole (consisting of the insole, the midsole and the outsole) provides the wearer in motion with the feeling that the sole accurately conforms to the foot of the wearer, the midsole yielding at the curved bending lines, in addition to absorbing shock at the heel and providing side support to the heel of the wearer. In addition hereto the finger-shaped zones may yield differently under the bones of the wearer's foot, the wearer's toes and associated bones of the foot must be able to move slightly differently from each other. The reason why it is important that the finger-shaped zone may move dependent on the bones of the wearer's foot is that the said toes with bones of the foot otherwise would be subjected to considerable heat-generating frictional forces.

According to the invention the bending lines may each have a varying radius of curvature, the radius of curvature preferably being longest at the centre of the bending lines and shortest at the end of the lines, and the front end of each bending line may slope "upwards" towards the side at which with the hallux zone of the sole is situated. The shoe of which the finished sole is to form part is thus particularly comfortable.

Furthermore according to the invention the elastic portion may form part of the upper face of the midsole and preferably be made of a comparatively hard ethylene vinyl acetate (EVA), while the rest of the sole may be made of a comparatively soft EVA. The wearer of the completed shoe sole will then feel that the elastic portion "conforms" to organic tissue of the foot in motion such that less friction arises between said portion and said tissue. Consequently the shoe will not feel uncomfortably hot, but is comfortable to walk in.

According to the invention the elastic portion may form part of the midsole, whereby the finished sole becomes particularly comfortable to use. When a person for instance ascends an inclined surface, he exerts a higher compressive force on the portion of the foot corresponding to the hallux. However, due to its elasticity said elastic portion induces a "push-off" effect in the foot at the start of a step. When a wearer for instance descends an inclined surface, he exerts a higher compressive force on the little toe side of the sole (in the same way as a skier attempting to stop his skies by letting the tips of the skies point towards each other (to plough)). The finger-shaped zone may provide the wearer with an extra push during the last part of a step when descending the inclined surface.

According to the invention the midsole may be provided with at least one area with corrugation-like projections on its lower face and within the elastic portion. As a result the finished sole possesses a particularly high flexibility in the longitudinal direction and stability in the transverse direction.

Furthermore according to the invention the corrugations may be substantially parallel in each area, whereby the flexibility also is enhanced.

According to the invention adjacent the heel zone of the midsole an area containing a number of, preferably at least three, parallel corrugations substantially perpendicular to the longitudinal axis of the sole may be provided. This embodiment turned out to be particularly advantageous.

According to the invention a system of substantially parallel corrugations optionally substantially following curved lines may be provided in the areas within the finger-shaped zones and/or in the areas outside the area of the ball of the foot in the elastic portion. This embodiment of the sole has also proved to provide the finished sole with a high flexibility.

Moreover according to the invention with the longitudinal axis of the midsole the corrugations within each finger zone may form an angle $v_1$ of approximately 70–80°, at the finger adjacent the hallux zone of the sole and an angle $v_2$ of approximately 40–60°, at the finger adjacent the little toe zone of said sole, whereby the midsole and thus the finished sole possesses a particularly foot-friendly flexibility.

According to the invention a part of the particularly elastic portion may extend substantially from the centre of the heel zone to a position past the zone of the ball of the foot, but ends prior to the toe zones of the midsole and optionally extends upwards in one or both of the lateral parts of the midsole at the instep of the midsole. As a result an enhance stability of the foot is obtained.

The invention further relates to a shoe sole comprising the shoe midsole described in claims 1–10, an upper insole, a sock of the sandwich-type provided overtop the insole, and an outsole provided beneath the midsole. This shoe sole is characterised in that a comparatively smooth portion, preferably made of leather or plastics, is provided in the hallux zone of the sock and in at least a portion of the zone of the ball of the foot, whereby the finished shoe sole affords the wearer a particularly high comfort during walking.

BRIEF DESCRIPTION OF THE DRAWINGS

The invention is explained in detail below with reference to the accompanying drawings, in which FIG. 3 is a sectional view of an embodiment along the line III—III in FIG. 1, FIG. 4 is a bottom view of an embodiment of the sole provided with corrugations, FIG. 5 is a sectional view along the line V—V in FIG. 4, FIG. 6 is a side view of an embodiment of the sole, in which the particularly elastic portion slopes upwardly at the instep zone thereof.

BEST MODE FOR CARRYING OUT THE INVENTION

Figure 1:
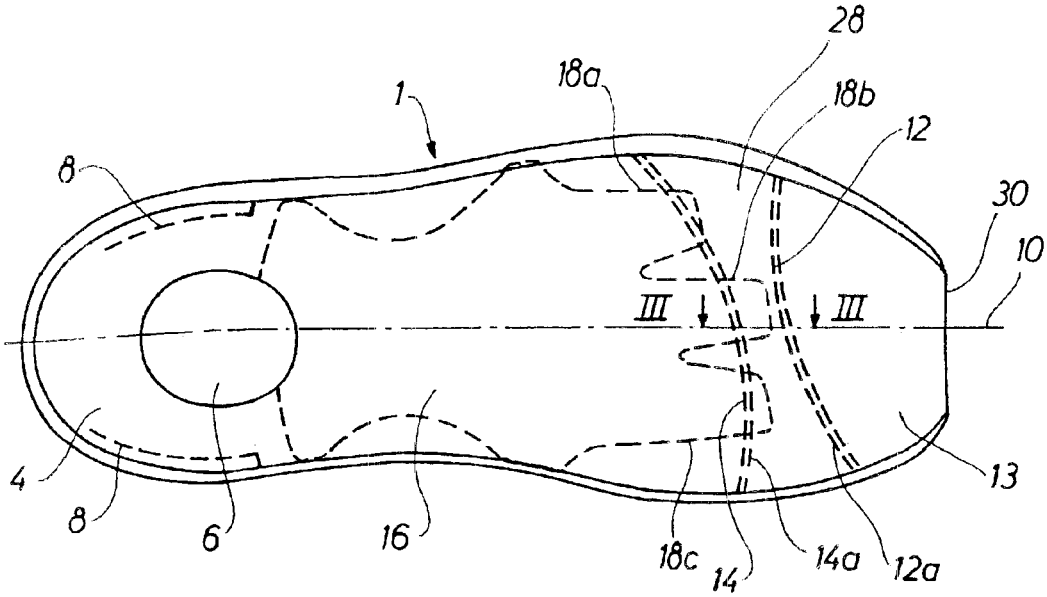
FIG. 1 is a top view of an embodiment of the sole according to the invention.

The shoe midsole shown in FIG. 1 affording an exceptionally comfortable walking experience and eg suitable for manufacturing hiking shoes, is denoted as a whole by the reference numeral 1. In its heel zone 4 the sole is provided with a shock absorber 6 and at least one bead 8 behind and adjacent the heel zone, said bead completely or partially following a U-shape and acting as side support for the heel of the shoe wearer. The bead is only indicated by means of a dotted line. The shock absorber is preferably pneumatic or of a particularly shock-absorbing sole material.

The shoe midsole is flexible about two slightly curved bending lines 12,14 which are inclined relative to the longitudinal axis 10 of the sole, said bending lines being defined by channels or grooves in the sole material, confer FIG. 3. The bending lines 12,14 do not intersect each other and their cavities face away from each other. Each of the convex sides 12*a*, 14*a* faces towards the other. Each of the bending lines 12,14 may have a varying radius of curvature; it is usually shortest at the centre of the bending line and longest towards the end of the line. The front end 14,12*a* of the bending lines may slope "upwards" towards the side at which the hallux zone 13 of the midsole is present, as shown in FIG. 1.

The midsole has a particularly elastic portion 16 of a hand-like shape (shown dotted) with at least two finger-shaped zones pointing towards the toe end 30 of the sole. In the present case three such finger-shaped zones 18*a*, 18*b* and 18*c* are shown. As shown in FIG. 1 the elastic portion 16, which has been moulded or inserted into the remaining portion of the midsole material, forms part of the upper face of the midsole, but may be completely circumscribed by the remaining midsole material. The elastic portion 16 is preferably made of a comparatively hard ethylene vinyl acetate (EVA), while the rest of the sole is made of a comparatively soft EVA.

Figure 2:
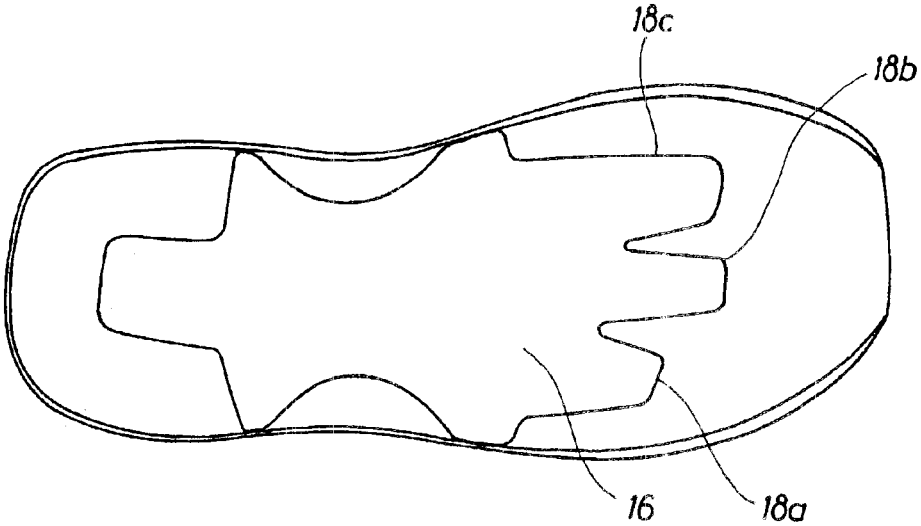
FIG. 2 is a bottom view of a second embodiment of the sole.

The elastic portion 16 may also be part of the lower face of the midsole, as shown in FIG. 2.

On its lower face and within the elastic portion 16 the midsole may be provided with at least one area 20,21,22,23 with corrugation-like projections 25, confer FIG. 4. The dotted lines 25 indicate the "vales" of the corrugations. FIG. 5 illustrate some corrugations 25 in enlarged scale and in cross-section.

As shown the corrugations may be substantially parallel in each area.

As shown in FIG. 4 an area 20 with a number of, preferably at least three, parallel corrugations may be provided within the heel zone 4, said corrugations extending substantially perpendicular to the longitudinal axis 10 of the sole, confer FIG. 1. The "vales" of the corrugations are also here indicated at 25.

In the areas 21, 22, 23 within the finger-shaped zones 18*a*, 18*b*, 18*c* and/or in an area 27 opposite the zone of the ball of the foot in the elastic portion a system of substantially parallel corrugations 25 may be provided, optionally said corrugations substantially following curved lines, eg of a fairly light curvature.

As shown in FIG. 4, the corrugations 21, 22, 23 within the zone of each finger 18*a*, 18*b*, 18*c* may form an angle with the longitudinal axis 10 of the midsole, said angle $v_1$ being about 70–80° as regards the finger zone 18*c* adjacent the hallux zone 15 of the midsole and the angle $v_2$ of the corrugations in the finger zone 18*a* adjacent the little toe zone 28 being about 40–60°.

The particularly elastic portion 16 in the midsole may extend substantially from the centre of the heel zone to a position past the zone of the ball of the foot 27, but ends prior to the toe zone of the midsole 1.

As shown in FIG. 6, a part 16*a* of the particularly elastic portion 16 may extend upwards in one or both of the lateral parts of the sole at the instep of the sole.

Figure 7:
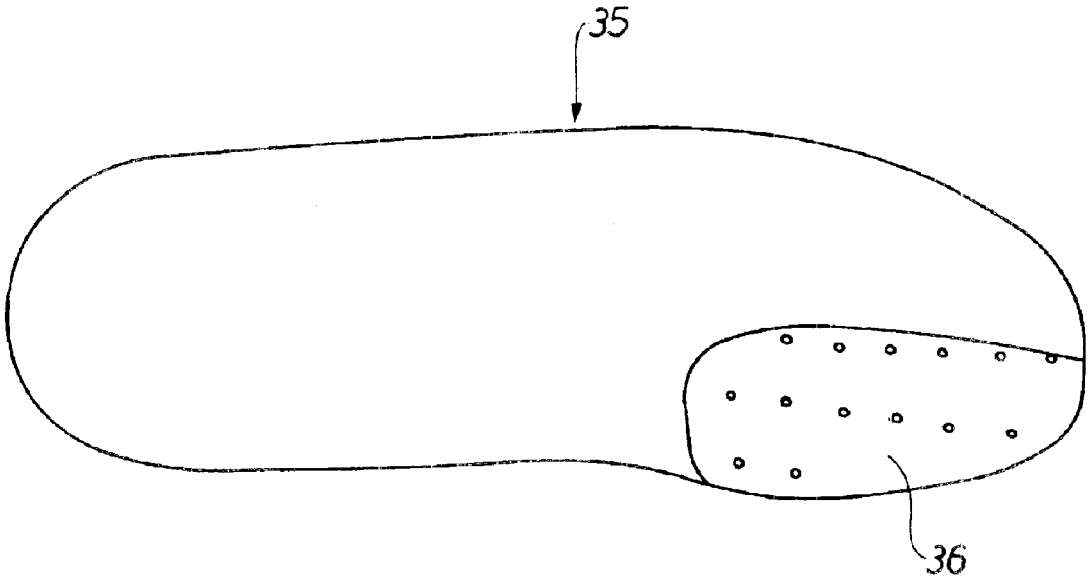
FIG. 7 is a top view of a sock to be arranged atop an insole provided atop the midsole according to the invention.

The finished shoe sole normally consists of the midsole 1 according to the invention, an insole, a sock of the sandwich type atop the insole, and an outsole provided beneath the midsole 1. The sock is shown in FIG. 7 at reference numeral 35. The sock may have a smooth portion 36, preferably of leather or plastics in its hallux zone and in at least one portion of the zone of the ball of the foot. In connection with the present midsole, this embodiment of the sock has proved to further enhance the walking comfort.

The invention may be modified in many ways without thereby deviating from the scope of the invention, as it appears from the attached claims.

What is claimed is:

1. A shoe midsole (1) for shoes affording exceptional walking comfort, said shoe midsole provided with a shock absorber (6) in its heel zone (4) and at least one bead behind and adjacent the heel zone, said bead completely or partially following a U-shape and forming a side support for the heel of the wearer, characterized in that it is flexible about at least two slightly curved bending lines (12,14) which are inclined relative to the longitudinal axis (10) of the midsole, said lines being defined by channels or grooves (12, 14) in the midsole material and not intersecting each other, the cavities of said bending lines facing opposite of each other, and in that the shoe midsole (1) is provided with a particularly elastic portion (16) of a hand-like shape with at least two finger-shaped zones (18*a*, 18*b*, 18*c*) pointing towards the toe end (30) of the midsole.

2. Shoe midsole according to claim 1, characterised in that each of the bending lines (12, 14) has a varying radius of curvature ($R_1$) and ($R_2$), the radius of curvature being longest at the center of each of the bending lines and shortest at the end of the lines and that the front end of each bending line slopes "upwards" towards the side at which a hallux zone (13) of the midsole is situated.

3. A shoe midsole according to claim 1, characterised in that the elastic portion (16) forms part of an upper face of the midsole and is made of a comparatively hard ethylene vinyl acetate (EVA), while the rest of the sole is made of a comparatively soft EVA.

4. A shoe midsole according to claim 1, characterised in that the elastic portion (16) is part of the a lower face of the midsole (1).

5. A shoe midsole according to claim 1, characterised in that it is provided with at least one area (7, 18*a*, 18*b*, 18*c*) with corrugation-like projections (20, 21, 22, 23, 25) on its lower face and within the elastic portion (16).

6. A shoe midsole according to claim 5, characterised in that corrugations within each area (20, 21, 22, 23) are substantially parallel.

7. A shoe midsole according to claim 1, characterised in that the heel zone (4) of the midsole is provided with an area (20) containing at least three parallel corrugations (25) substantially perpendicular to the longitudinal axis (10) of the sole.

8. A shoe midsole according to claim 1, characterised in that a system of substantially parallel corrugations (25) substantially following curved lines is provided in the areas (21, 22, 23) within the finger-shaped zones (18*a*, 18*b*, 18*c*) and/or in an area (27) opposite the elastic portion (16).

9. A shoe midsole according to claim 8, characterised in that with the longitudinal axis (10) of the midsole the corrugations (25) within each finger zone form an angle ($v_1$) of approximately 70–80° at the finger adjacent a hallux zone (13) of the midsole and an angle ($v_2$) of approximately 40–60° at the finger adjacent a little toe zone (28) of said midsole.

10. A shoe midsole according to claim 1, characterised in that a part (16*a*) of the elastic portion (16) extends substantially from the center of the heel zone (4) to a position past a zone of the ball of the foot (27), but ends prior to the toe zones of the midsole and extends upwards in one or both lateral parts of the midsole at the instep of the midsole.

11. A shoe sole comprising the shoe midsole described in claim 1, an insole, a sock (35) of a sandwich-type provided overtop the insole, and an outsole, characterised in that a comparatively smooth portion (36) made of leather or plastics is provided in the hallux zone of the sock (35) and in at least one portion of the zone of the ball of the foot.

* * * * *